US010974366B2

(12) United States Patent
Huang

(10) Patent No.: US 10,974,366 B2
(45) Date of Patent: Apr. 13, 2021

(54) CONDITIONING WHEEL FOR POLISHING PADS

(71) Applicant: Taiwan Semiconductor Manufacturing Co., Ltd., Hsinchu (TW)

(72) Inventor: Chun-Hsi Huang, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 415 days.

(21) Appl. No.: 15/988,435

(22) Filed: May 24, 2018

(65) Prior Publication Data

US 2019/0358771 A1 Nov. 28, 2019

(51) Int. Cl.
*B24B 53/00* (2006.01)
*B24B 53/017* (2012.01)
*B24B 37/04* (2012.01)

(52) U.S. Cl.
CPC ..... *B24B 53/017* (2013.01); *B24B 37/042* (2013.01)

(58) Field of Classification Search
CPC ..... B24B 53/17; B24B 37/042
USPC ..... 451/56, 353, 514, 443
See application file for complete search history.

(56) References Cited

U.S. PATENT DOCUMENTS 1,928,390 A * 9/1933 Myers ..... B24B 41/047 451/353
1,932,319 A * 10/1933 Myers ..... B24B 41/047 451/353
3,464,166 A * 9/1969 Bouvier ..... B24D 13/14 451/548
3,517,466 A * 6/1970 Bouvier ..... B24D 13/14 451/490
4,219,898 A * 9/1980 Presby ..... A47L 11/164 15/180
4,614,380 A * 9/1986 Allen ..... B24B 7/186 15/236.01
6,077,155 A * 6/2000 Hayakawa ..... B24B 37/30 451/288
6,139,428 A * 10/2000 Drill ..... B24B 53/017 451/286
6,190,243 B1 * 2/2001 Wada ..... B24B 53/017 451/285
6,213,856 B1 * 4/2001 Cho ..... B24B 53/017 451/443
6,514,126 B1 * 2/2003 Vanell ..... B24B 37/04 451/443
6,764,389 B1 * 7/2004 Butterfield ..... B24B 53/017 451/285

(Continued)

*Primary Examiner* — George B Nguyen

(74) *Attorney, Agent, or Firm* — Sterne, Kessler, Goldstein & Fox P.L.L.C.

(57) ABSTRACT

The present disclosure describes a chemical mechanical planarization system that includes a pad on a rotating platen, a wafer carrier configured to hold the wafer surface against the pad and apply pressure to the wafer, a slurry dispenser configured to dispense slurry on the pad, and a conditioning wheel configured to condition the pad. The conditioning wheel further includes a base and one or more flexible structures attached to the base with each flexible structure having an elastic body configured to exert a downforce on a feature of the pad, where the downforce is proportional to the height of the feature.

20 Claims, 11 Drawing Sheets

(56) References Cited

U.S. PATENT DOCUMENTS

| | | | | |
|---|---|---|---|---|
| 6,796,885 | B2 * | 9/2004 | Vanell | B24B 37/04 451/14 |
| 7,182,680 | B2 * | 2/2007 | Butterfield | B24B 53/017 451/443 |
| 7,510,463 | B2 * | 3/2009 | Kim | B24B 53/017 451/443 |
| 8,272,924 | B2 * | 9/2012 | Van Eijden | B24D 7/066 451/56 |
| 2005/0282476 | A1 * | 12/2005 | Lujan | B24B 53/003 451/56 |
| 2010/0112900 | A1 * | 5/2010 | Basim | B24B 53/017 451/5 |
| 2010/0203813 | A1 * | 8/2010 | Ward | B24B 7/186 451/353 |
| 2014/0315473 | A1 * | 10/2014 | Chen | B24B 53/017 451/56 |
| 2016/0346901 | A1 * | 12/2016 | Chou | B24D 18/0027 |

* cited by examiner

CONDITIONING WHEEL FOR POLISHING PADS

BACKGROUND

Polishing pad conditioners "re-energize" the pad's surface and extend its lifetime by ensuring the consistency and the stability of the chemical mechanical planarization (CMP) process. New generations of slurries and polishing pads require greater precision of the pad conditioners, conditioning equipment, and conditioning methods.

BRIEF DESCRIPTION OF THE DRAWINGS

Aspects of the present disclosure are best understood from the following detailed description when read with the accompanying figures. It is noted that, in accordance with common practice in the industry, various features are not drawn to scale. In fact, the dimensions of the various features may be arbitrarily increased or reduced for clarity of discussion.

DETAILED DESCRIPTION

Figure 1:
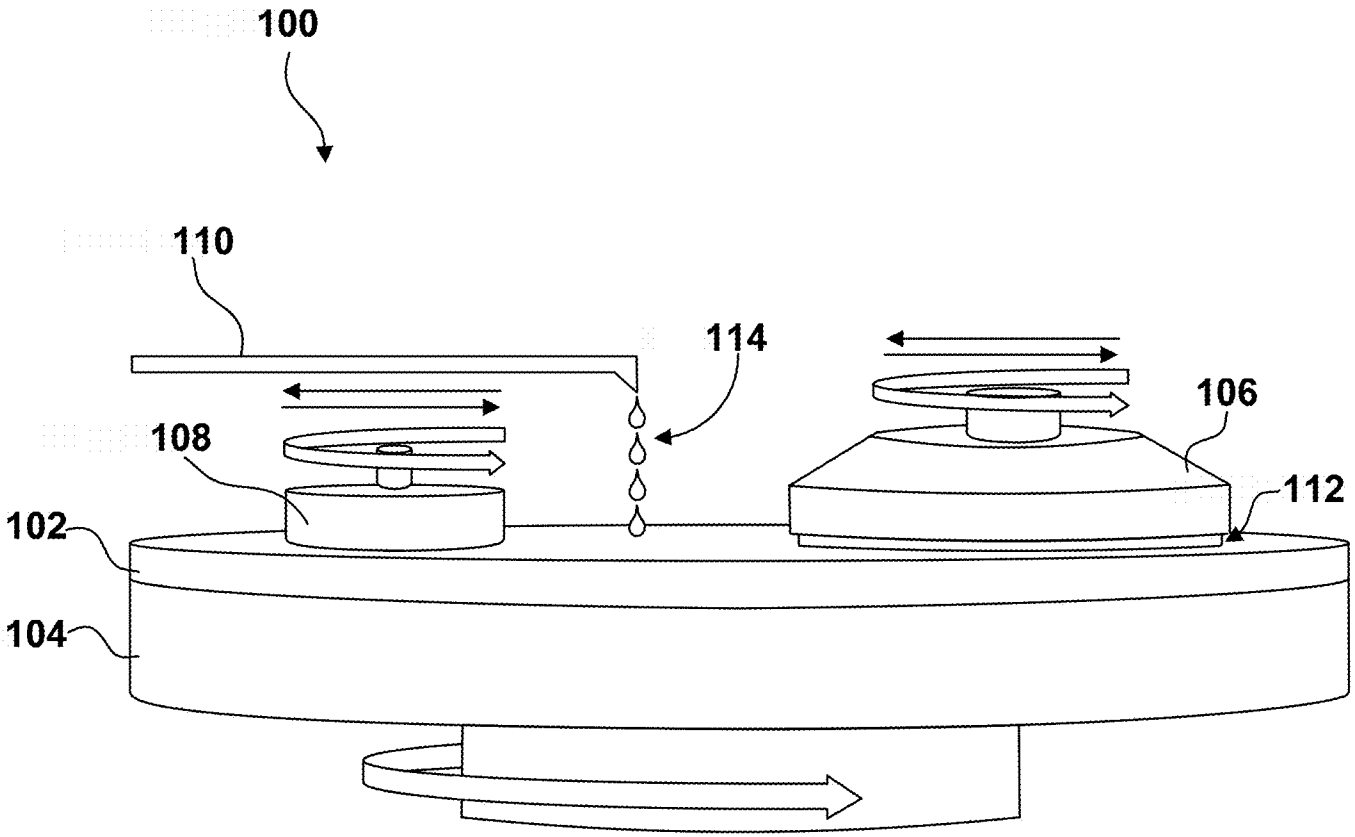
FIG. 1 is a cross-sectional view of a polishing tool, according to some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over a second feature in the description that follows may include embodiments in which the first and second features are formed in direct contact, and may also include embodiments in which additional features may be formed that are between the first and second features, such that the first and second features are not in direct contact.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The term "nominal" as used herein refers to a desired, or target, value of a characteristic or parameter for a component or a process operation, set during the design phase of a product or a process, together with a range of values above and/or below the desired value. The range of values is typically due to slight variations in manufacturing processes or tolerances.

The term "substantially" as used herein indicates the value of a given quantity varies by ±5% of the value.

The term "about" as used herein indicates the value of a given quantity that can vary based on a particular technology node associated with the subject semiconductor device. Based on the particular technology node, the term "about" can indicate a value of a given quantity that varies within, for example, 10-30% of the value (e.g., ±10%, ±20%, or ±30% of the value).

The term "vertical," as used herein, means nominally perpendicular to the surface of a substrate.

Chemical mechanical planarization (CMP) is a global wafer surface planarization technique that planarizes the wafer's surface by relative motion between a wafer and a polishing pad in the presence of a slurry while applying pressure (downforce) to the wafer. The CMP tool is referred to as a "polisher." In a polisher, the wafer is positioned face down on a wafer holder, or carrier, and held against a polishing pad which is positioned on a flat surface referred to as a "platen." Polishers can use either a rotary or orbital motion during the polishing process. CMP achieves wafer planarity by removing elevated features on the surface of the wafer relative to recessed features. The slurry and the polishing pad are referred to as "consumables" because of their continual usage and replacement. The slurry and the polishing pad are therefore critical components and their condition needs to be continuously monitored.

The slurry is a mixture of fine abrasive particles and chemicals that are used to remove specific materials from the wafer's surface during the CMP process. Precise slurry mixing and consistent batch blends are critical for achieving wafer to wafer (WtW) and lot to lot (LtL) polishing repeatability (e.g., consistent polish rate, consistent polish uniformity across the wafer and across the die, etc.). The quality of the slurry is important so that scratches on the surface of the wafer are avoided during the CMP process.

The polishing pad attaches to the top surface of the platen. The pad can be made, for example, from polyurethane due to polyurethane's mechanical characteristics and porosity. Further, the pad can feature small perforations to help transport the slurry along the wafer's surface and promote uniform polishing. The pad also removes the reacted products away from the surface of the wafer. As the pad polishes more wafers, the pad's surface becomes flat and smooth, causing a condition referred to as "glazing." Glazed pads cannot hold the polishing slurry-which significantly decreases the polishing rate.

Polishing pads require regular conditioning to retard the effects of glazing. The purpose of conditioning is to extend the pad's lifetime and provide consistent polishing performance throughout its life. Pads can be conditioned with mechanical abrasion or a deionized (DI) water jet spray that can agitate (activate) the pad's surface and increase its roughness. An alternative approach to activate the pad's surface is to use a conditioning wheel ("disk") featuring a bottom diamond surface that contacts the pad while it rotates. The conditioning process inevitably removes pad surface material and it is a significant factor in the pad's lifetime. Conditioning can be performed either in-situ (internal) or ex-situ (external) of the CMP tool. In in-situ conditioning, the conditioning process is performed in real-time, where the pad conditioning wheel or disk is applied to one portion of the pad while the wafer polishing occurs on another portion of the pad. In ex-situ pad conditioning, the conditioning is not performed during polishing but only after a predetermined number of wafers is polished. Eventually the polishing pad will have to be replaced. For example, 3000 or more wafers can be processed before the polishing pad is replaced.

Pad conditioning however has its challenges and it is not a straightforward process. For example, as the pad is conditioned over its lifetime, the pad's surface becomes increasingly un-even-more so at the edges of the pad due to inherent mechanical limitations (e.g., the size of the wheel or disk). Further, the pad's surface can become uneven as it polishes an increasing number of wafers. Therefore, during conditioning, if the wheel exerts the same downforce to all the features of an uneven surface, the surface uniformity of the pad will not improve over time. For instance, the uneven profile (e.g., surface contour) of the pad's surface will propagate through as pad material is removed from its surface during the conditioning process. There is also the possibility that the uneven profile of the pad's surface becomes progressively worse over time. Consequently, as the pad is repeatedly conditioned, its polishing ability (removal rate) deteriorates through its lifetime. In other words, the pad's lifetime and performance is impacted, which in turn increases the CMP cost and yield loss.

The present disclose is directed to conditioning wheels with retrofitted flexible structures attached to their bottom surface. In some embodiments, the flexible structures provide different downforce "paths" for uneven features on the pad's surface. Therefore, the surface flatness of the polishing pad is maintained throughout the lifetime of the pad—in other words, the pad's lifetime can be extended. In some embodiments, the flexible structure includes an "elastic body"—such as a steel spring, a poromeric, or an elastomer—that can be attached directly under the base of a conditioning wheel. In other embodiments, in addition to the elastic body under the wheel, a support frame is employed to prevent skewing of the wheel's working surface (e.g., a diamond film that contacts the pad). According to some embodiments, the elastic body can be located partially inside the base of the wheel.

FIG. 1 is an isometric view of components of an exemplary CMP polisher 100 (thereafter "polisher 100"), according to some embodiments. Polisher 100 includes a polishing pad 102 (thereafter "pad 102") which is loaded on a rotating platen (e.g., a rotating table) 104. Polisher 100 also includes a rotating wafer carrier 106, a rotating conditioning wheel (or "disk") 108, and a slurry feeder 110. For illustration purposes, FIG. 1 includes selected portions of polisher 100 and other portions (not shown) may be included, such as chemical delivery lines, drain lines, control units, transfer modules, pumps, etc. A wafer 112 to be polished is mounted face-down at the bottom of wafer carrier 106 so that the wafer's top surface contacts the top surface of pad 102. Wafer carrier 106 rotates wafer 112 and exerts pressure (e.g., downforce) on it so that wafer 112 is pushed against rotating pad 102. Slurry 114, which includes chemicals and abrasive particles, is dispensed on the pad's surface. Chemical reactions and mechanical abrasion between slurry 114, wafer 112, and pad 102 can result in material removal from the top surface of wafer 112. At the same time, conditioning wheel 108 agitates the top surface of pad 102 to restore its roughness. However, this is not limiting and conditioning wheel 108 can start conditioning pad 102 after wafer 112 has been polished and removed from polisher 100.

In some embodiments, platen 104, wafer carrier 106, and conditioning wheel 108 rotate in the same direction (e.g., clockwise or counter clockwise) but with different angular speeds (e.g., rotating speeds). At the same time, wafer carrier 106 can swing between the center and the edge of pad 102. On the other hand, conditioning wheel 108 may also swing between the center and the edge of pad 102 or along a different path. However, the aforementioned relative movements of the various rotating components, such as conditioning wheel 108 and wafer carrier 106, are not limiting.

In some embodiments, the physical and mechanical properties of pad 102 (e.g., roughness, material selection, porosity, stiffness, etc.) depend on the material to be removed from wafer 112. For example, copper polishing, copper barrier polishing, tungsten polishing, shallow trench isolation polishing, oxide polishing, or buff polishing require different type of pads in terms of materials, porosity and stiffness. The pads used in a polisher, like polisher 100, should exhibit some rigidity in order to uniformly polish the wafer surface. Pads, like pad 102, can be a stack of soft and hard materials that can conform to some extent to the local topography of wafer 112. By way of example and not limitation, pad 102 can include porous polymeric materials with a pore size between about 1 and about 500 μm.

Figure 2:
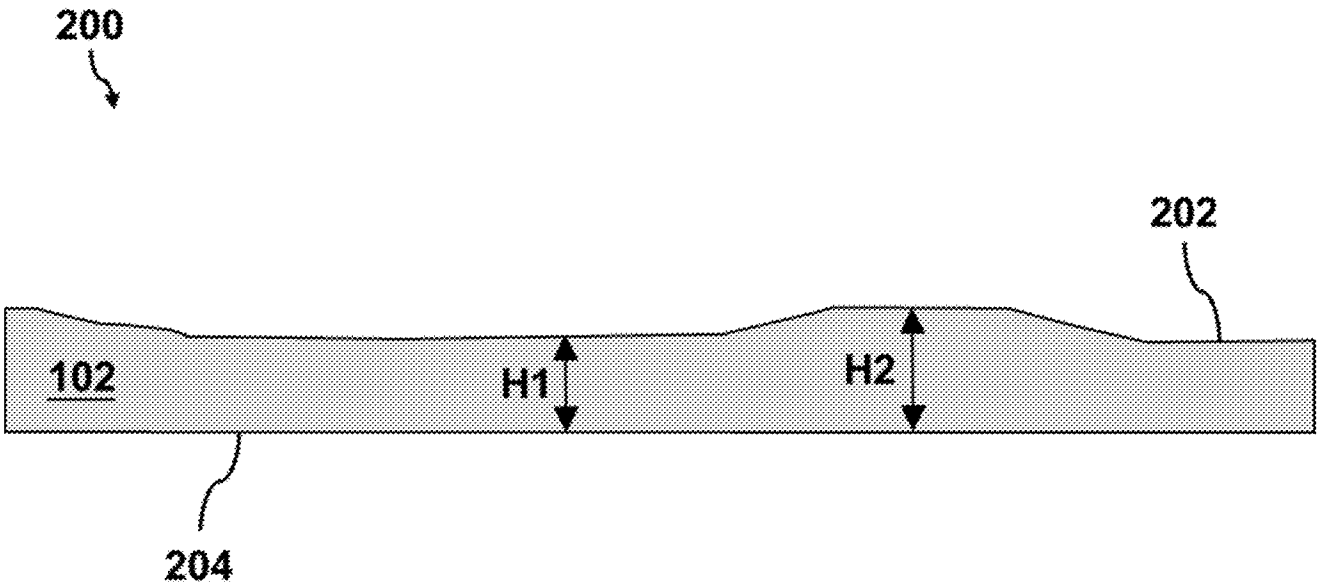
FIG. 2 is a cross-sectional view of a polishing pad, according to some embodiments.

According to some embodiments, FIG. 2 is cross-sectional view of an exemplary conditioned pad area 200 of pad 102 (also shown in FIG. 1). Conditioned pad area 200 can be the result of the continuous conditioning action of a conditioning wheel 108 that exerts the same downforce to all the features of the pad's top surface 202. Consequently, top surface 202 of conditioned pad area 200 has developed over time a local topography (e.g., a local non-uniformity) which is characterized by features having different heights H1 and H2 across pad area 200 with H2 being taller than H1 (e.g., H2>H1). In some embodiments, the height difference between a high (e.g., H2) and a low (e.g., H1) feature on the pad's top surface 202 can be up to 1 mm (e.g., H2 —H1<1 mm). The height of each feature is measured from the pad's bottom surface 204 to the highest point of the feature on the pad's top surface 202, as shown in FIG. 2. If the aforementioned conditioning wheel continues to treat pad area 200, the topography of pad area 200 will become more pronounced. For example, the height difference between the features with heights H1 and H2 respectively will increase and the uniformity of pad 200 pad area 200 will further deteriorate. As a result of this process, pad 102 will lose its polishing ability.

Figure 3:
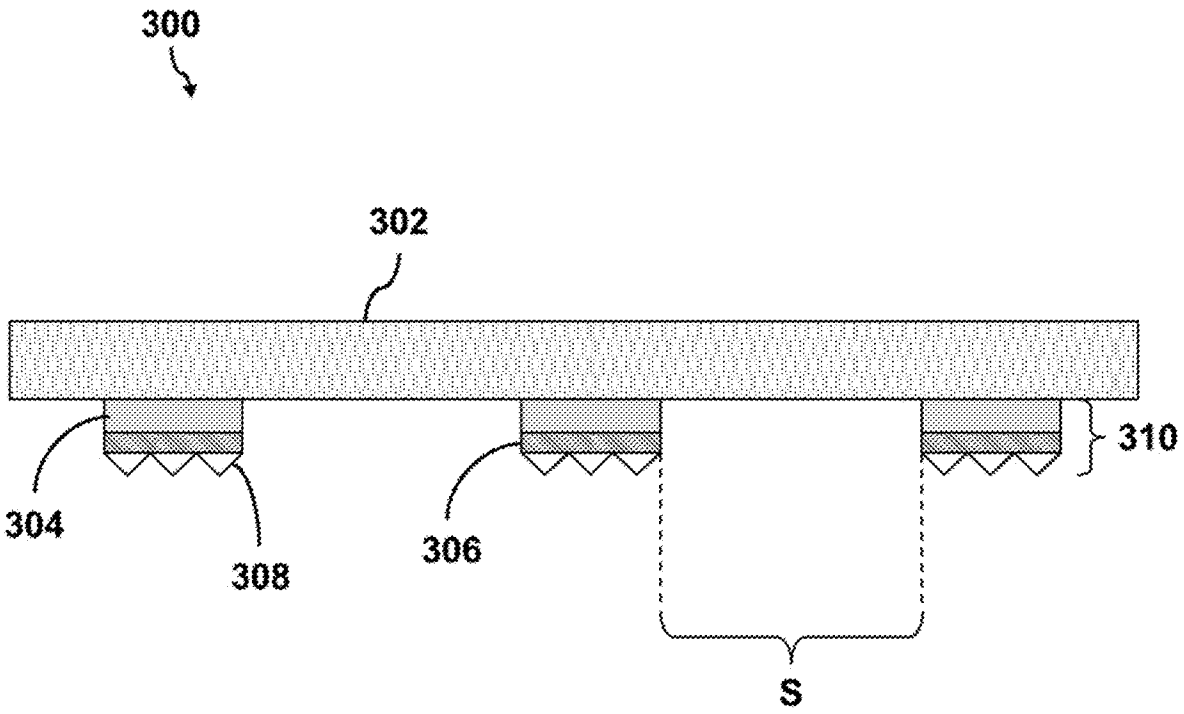
FIG. 3 is a cross-sectional view of an exemplary pad conditioning wheel with flexible structures, according to some embodiments.
Figure 4A:
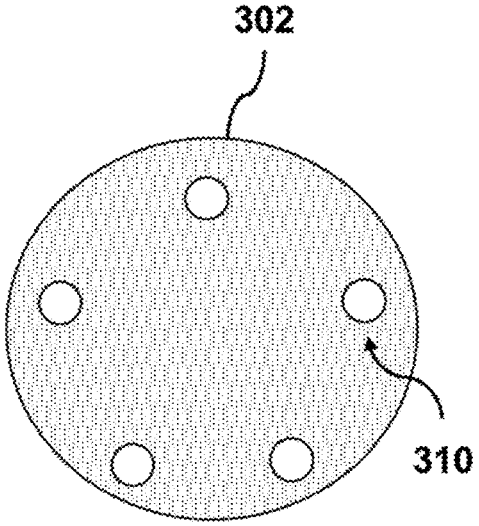
FIGS. 4A-4D are plan views of a backside surface of a conditioning wheel with different arrangements of flexible structures, according to some embodiments.
Figure 4B:
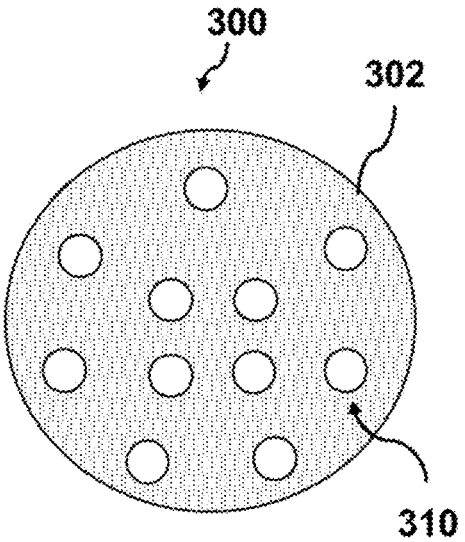
Figure 4C:
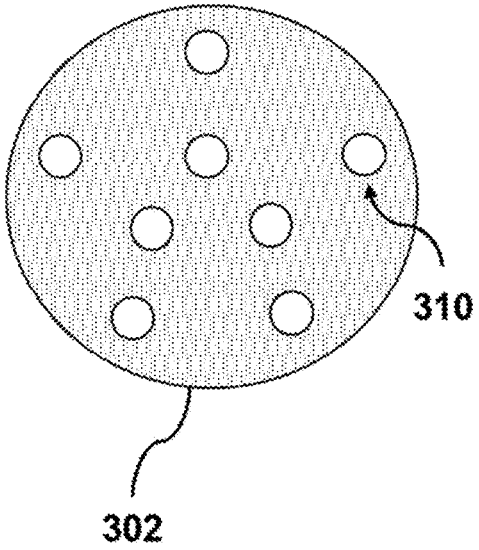
Figure 4D:
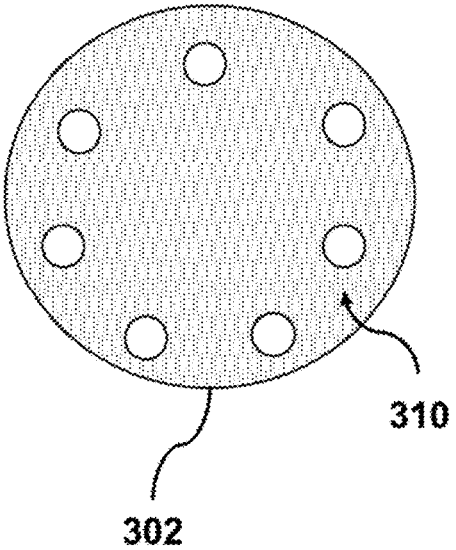

FIG. 3 is a cross-sectional view of an exemplary conditioning wheel 300, according to some embodiments. Conditioning wheel 300 includes a base 302 with a diameter of about 100 mm. One or more elastic bodies 304 are attached to base 302. The diameter of each elastic body 304 can range from about 0.1 mm to about 100 mm (e.g., 10 mm) and its height can range from about 1 mm to about 30 mm (e.g., 30 mm), according to some embodiments. By way of example and not limitation, each elastic body 304 can include a steel spring, a poromeric (e.g., a porous synthetic material based on polyurethane or another polymer), or an elastometer (e.g. elastic polymer). According to some embodiments, each elastic body 304 is attached to the side (e.g., bottom side or backside) of base 302 that is facing the pad (e.g., pad 102 shown in FIGS. 1 and 2).

In referring to FIG. 3, a solid base 306 is attached to each elastic body 304. Solid base 306 can be made of a metal alloy, a metal, or a plastic. For example, solid base 306 can be made of steel. Further, solid base 306 can have a height that can range from about 1 mm to about 30 mm (e.g., about 30 mm) and a diameter between about 0.1 mm to about 100 mm (e.g., about 10 mm). In some embodiments, the diameter of solid base 306 matches the diameter of the underlying elastic body 304.

Conditioning wheel 300 further includes a diamond film 308, which is disposed on each solid base 306. By way of example and not limitation, diamond film 308 can be formed by chemical vapor deposition (CVD) at a thickness of about 0.1 mm to about 30 mm (e.g., 30 mm). In some embodiments, diamond film 308 defines the "working area" of conditioning wheel 300. That is, the area of conditioning wheel 300 that contacts the pad and "activates" (conditions) the top surface of the pad. It is therefore important that diamond film 308 contacts the pad at all times during the conditioning process. Diamond film 308 can have a nanocrystalline or microcrystalline microstructure, according to some embodiments. By way of example and not limitation, the size of the diamond microcrystals or nanocrystals in diamond film 308 can range from about 1 μm to about 1000 μm.

Each elastic body 304—with diamond film 308 and solid base 306—can form a flexible structure 310. According to some embodiments, flexible structure 310 can follow the contour of the top surface of the pad. In other words, throughout the conditioning process the surface of diamond film 308 can remain in contact to the surface of each feature of pad 102 (e.g., shown in FIGS. 1 and 2)

In referring to FIG. 3, spacing S between adjacent flexible structures 310 can range from about 1 mm to less than about 100 mm depending on (i) the diameter of base 302, (ii) the diameter of each flexible structure 310, and (iii) the number of flexible structures 310 attached to the backside surface, or bottom surface, of base 302. FIGS. 4A-D are plan-views of the backside surface of base 302 that show exemplary arrangements of flexible structures 310 over the backside surface of base 302. These arrangements are not limiting and other arrangements of flexible structures 310 over the backside surface of base 302 are possible. Further, flexible structures 310 may not be limited to the same size and they may have different sizes. The number of flexible structures 310 can be driven by the desired conditioning rate for pad 102 and the diameter of base 302.

Figure 5:
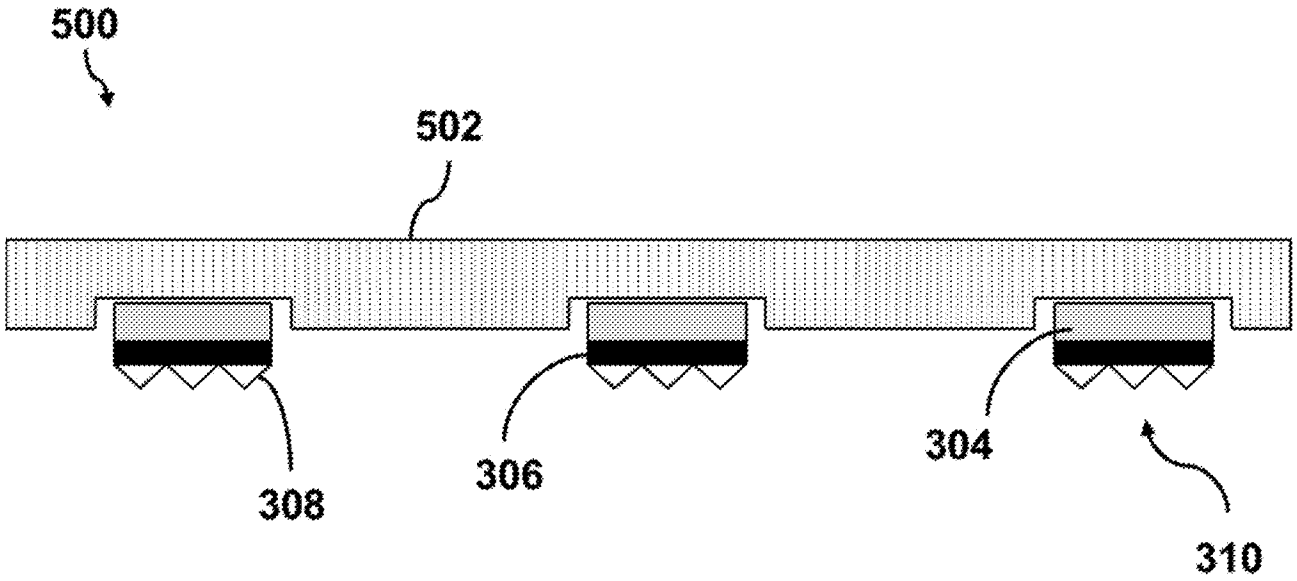
FIG. 5 is cross-sectional view of an exemplary conditioning wheel with flexible structures disposed partially in a base of the conditioning wheel, according to some embodiments.
Figure 6:
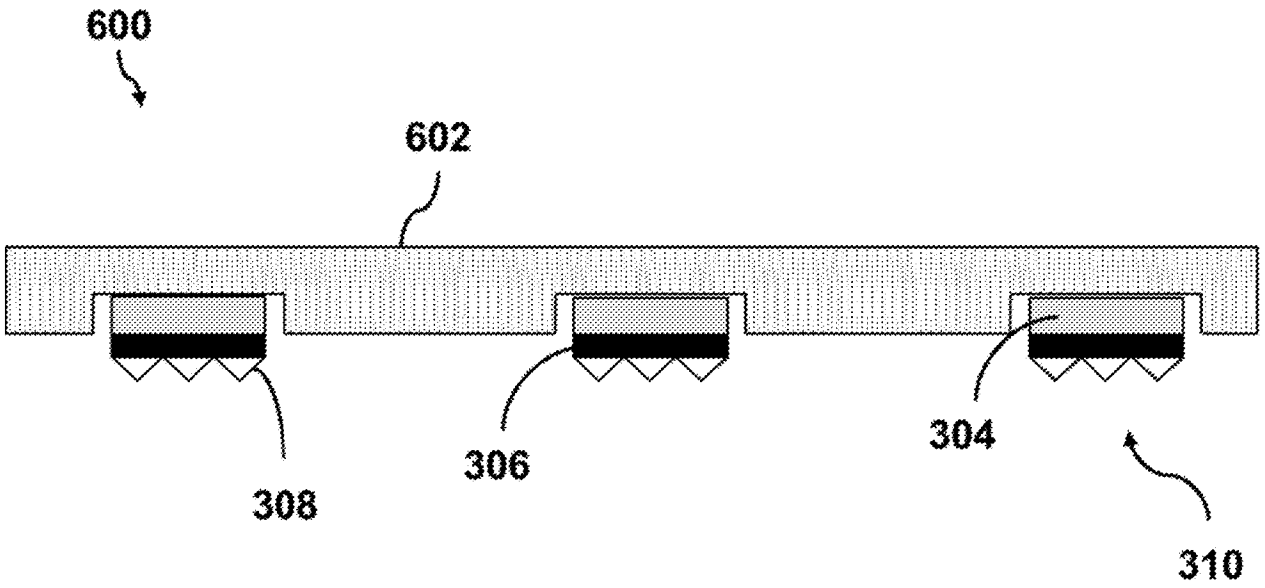
FIG. 6 is cross-sectional view of an exemplary conditioning wheel with flexible structures disposed partially in a base of the conditioning wheel, according to some embodiments.

In some embodiments, and referring to FIG. 5, elastic body 340 of flexible structure 310 can have at least part of its sidewall surrounded by the backside surface of base 502 in conditioning wheel 500. In another embodiment, and referring to FIG. 6, each elastic body 304 of flexible structure 310 can have its whole sidewall surrounded by the backside surface of base 602 in conditioning wheel 600. Therefore, the depth at which elastic body 304 of flexible structure 310 can be embedded in the backside surface of the wheel's base can range from about 0 mm (e.g., when attached on the top of backside surface of base 302, as shown in FIG. 3) to up to about 30 mm (e.g., when disposed partially or fully in the backside surfaces of bases 502 and 602, respectively, as shown in FIGS. 5 and 6)

Figure 7:
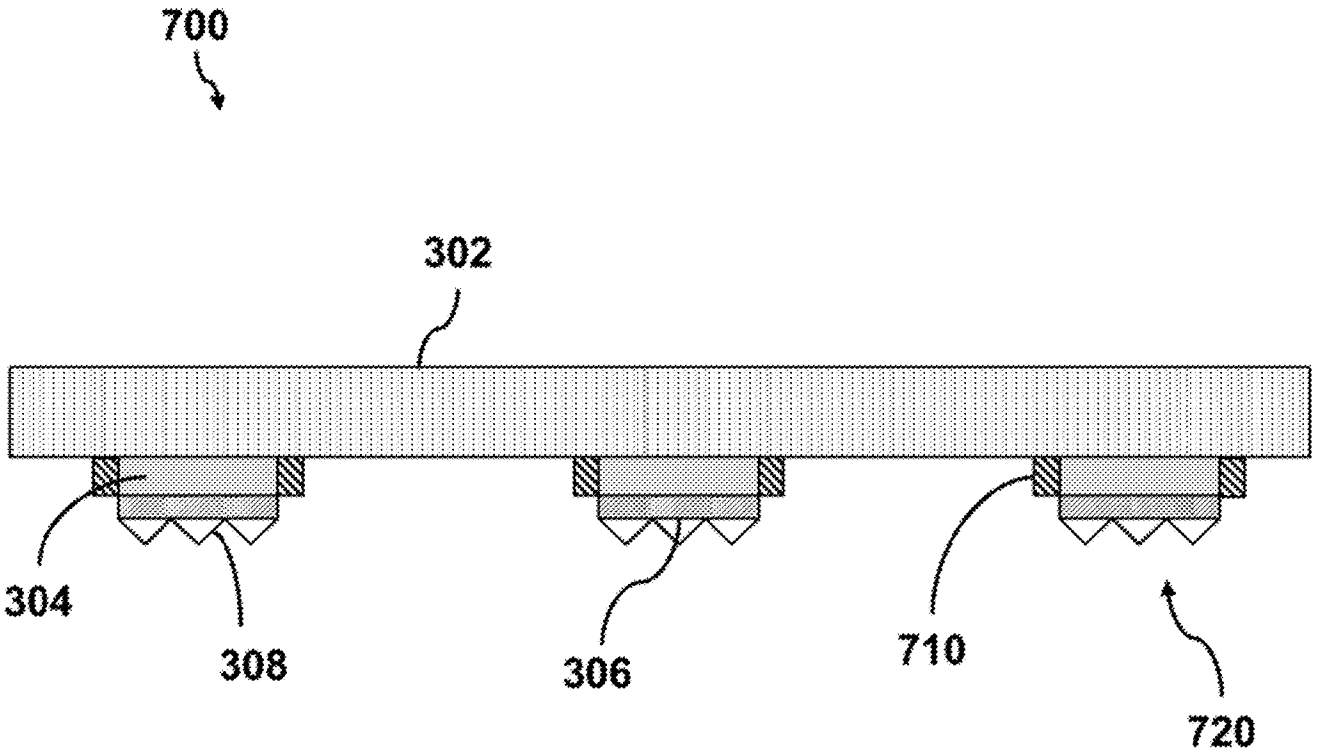
FIG. 7 is a cross-sectional view of an exemplary conditioning wheel with flexible structures featuring a support frame, according to some embodiments.

In some embodiments—for example, referring to FIG. 7 and conditioning wheel 700—each flexible structure 720 can include a support frame 710 that surrounds the sidewall surfaces of elastic body 304. Support frame 710 prevents bending of flexible structures 310 during the conditioning process. For example, due to the rotation of base 302 and the downforces applied to flexible structures 310, some flexible structures 310 may be susceptible to bending when travelling over the features of the pad's surface. Consequently, diamond film 308 can lose contact with the features on the pad's surface. This will impact the pad's surface topography. For example, it will exacerbate the local non-uniformity.

Figure 8:
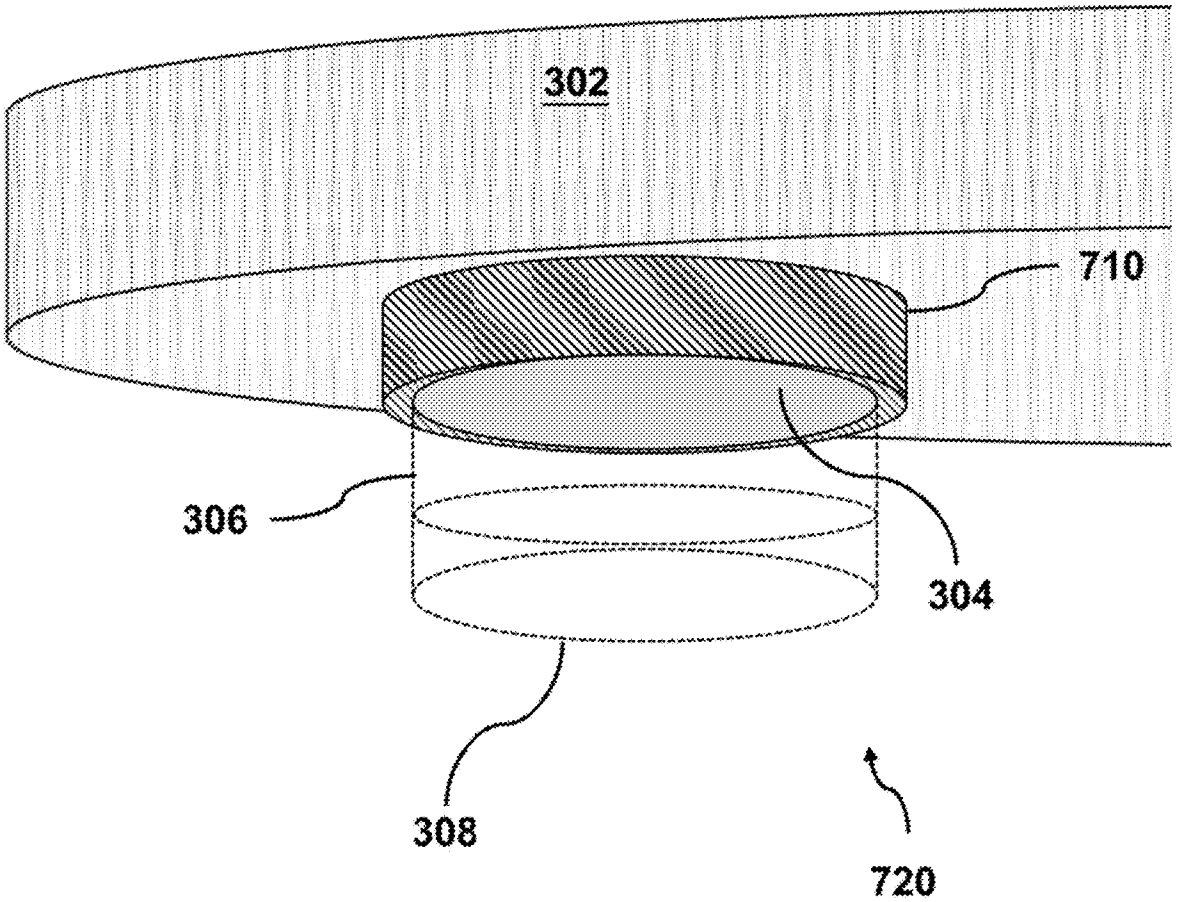
FIG. 8 is an isometric view of an exemplary flexible structure with a support frame, according to some embodiments.
Figure 9:
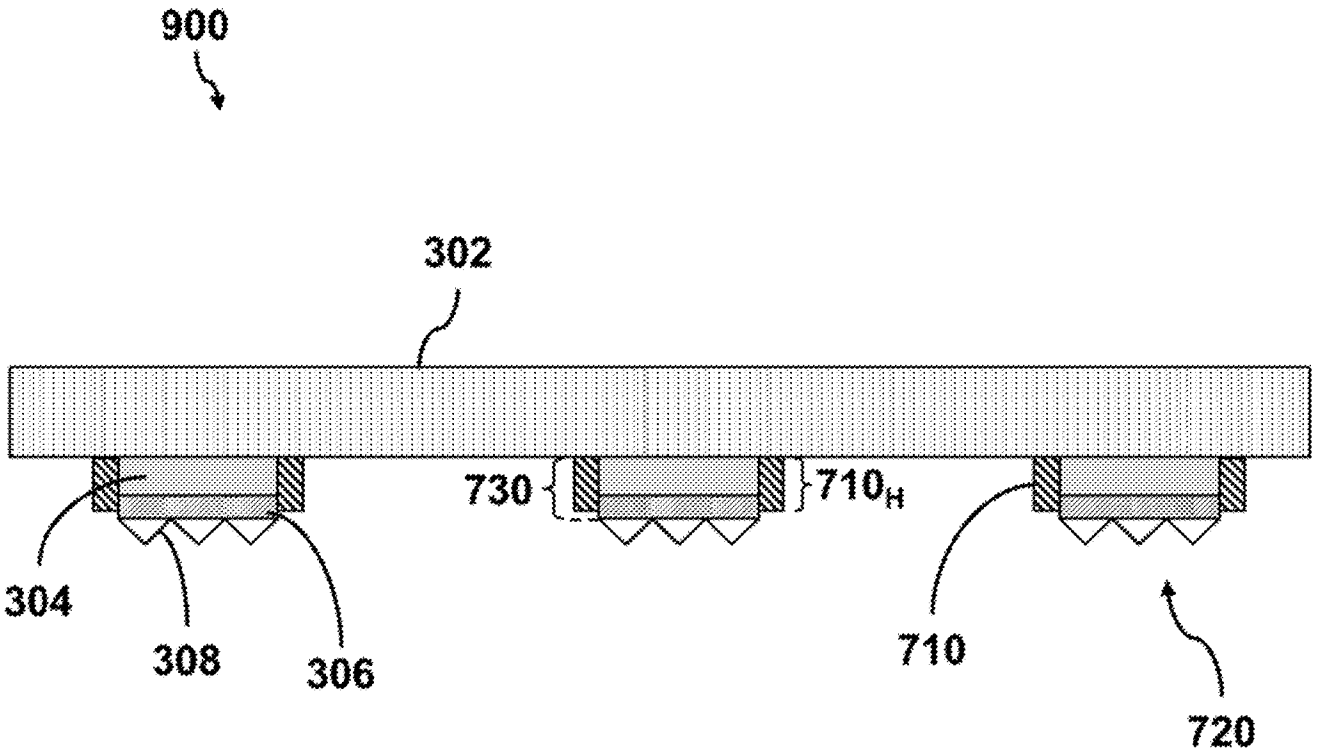
FIG. 9 is a cross-sectional view of an exemplary conditioning wheel with flexible structures featuring a support frame, according to some embodiments.

By way of example and not limitation, FIG. 8 is an isometric view of FIG. 7 showing flexible structure 720 on the backside surface of base 302 (e.g., on the surface facing the top surface of the pad) and support frame 710 surrounding elastic body 304, according to some embodiments. However, the depiction of support frame 710 in FIGS. 7 and 8 is exemplary and not limiting. For example, in some embodiments, support frame 710 surrounds elastic body 304 and a portion of solid base 306, as shown in FIG. 9, in conditioning wheel 900. In other words, the height $\mathbf{710}_H$ of support frame 710 can be shorter than the combined height 730 of elastic body 304 and solid base 306 (e.g., $\mathbf{710}_H<\mathbf{730}$). This can be advantageous when the range of motion for flexible structures 310 needs to be limited—for example, when the pad's surface is hard or to prevent the flexible structures from shearing.

Figure 10:
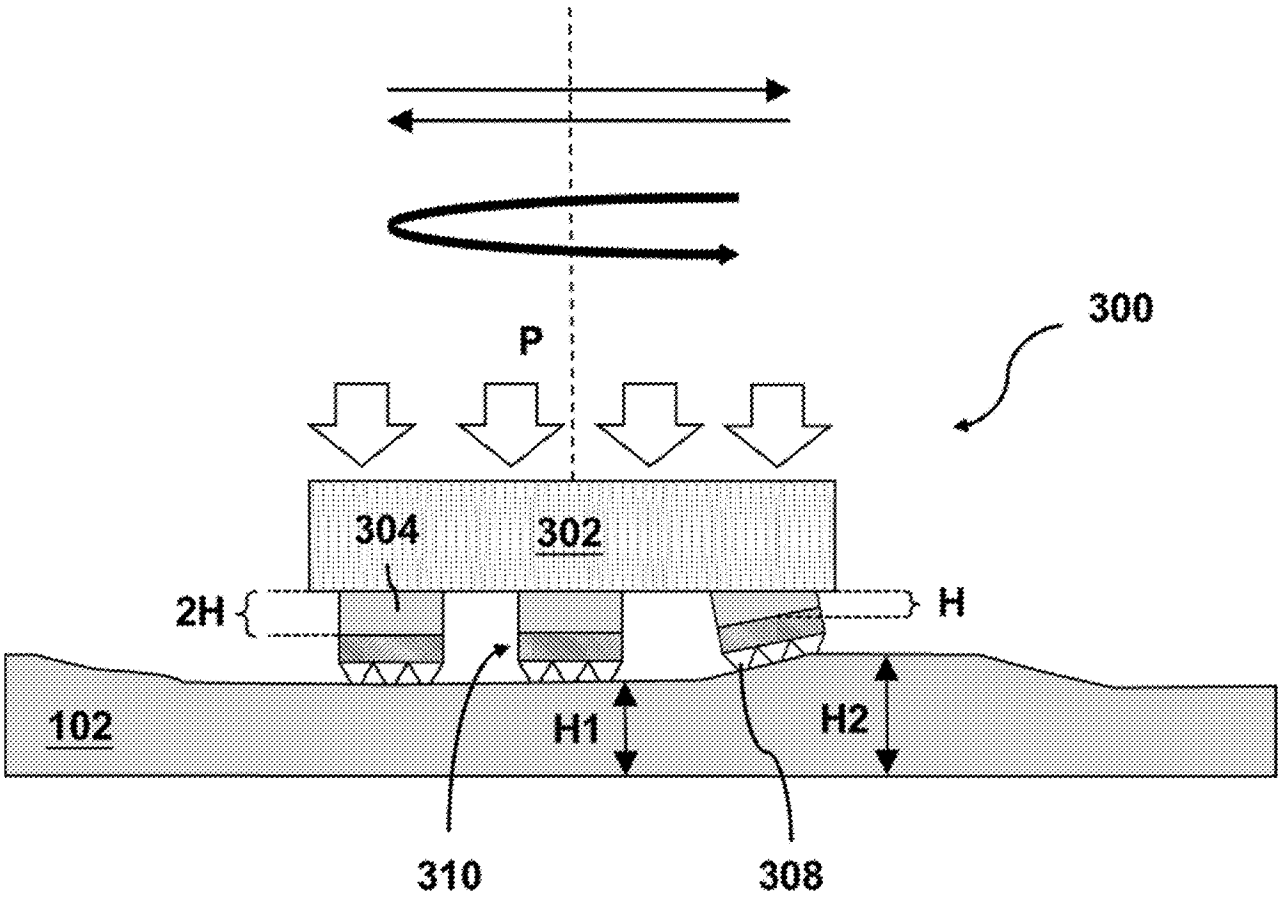
FIG. 10 is a cross-sectional view of an exemplary conditioning wheel with flexible structures on a polishing pad during a conditioning process, according to some embodiments.

According to some embodiments, FIG. 10 describes the operation of flexible structure 310 in suppressing local topography on the pad's surface during the conditioning process. By way of example and not limitation, when no pressure is applied to base 302, the height of elastic body 304 can be 3H. When pressure P is applied uniformly across to base 302, elastic body 304 deforms (e.g., compresses) as each flexible structure 310 is forced against a first and a second feature of pad 102 with respective heights H1 and H2, where H2 is greater than H1 (e.g., H1<H2). According to some embodiments, elastic body 304 will depress more on taller features (e.g., with height H2) than on shorter features (e.g., with height H1) as shown in FIG. 10. For example, on the first feature with height H1 (e.g. a flat surface of pad 102), the height of elastic body 304 will reduce, for example, from 3H to 2H and on the second feature with height H2 from 3H to H. In other words, elastic body 304 will be compressed more on a taller feature than on a shorter feature of pad 102. Further, assuming that the elastic coefficient of elastic body 304 is "k", the downforce applied by flexible structures 310 to the first and second features with different heights (H1 and H2, respectively) will be different due to the different compression that the elastic body is experiencing. For example, the downforce F1 applied to the first feature with height H1 will be:

$$F1=k\cdot(3H-2H) \text{ or } F1=k\cdot H,$$

and respectively the downforce F2 applied to the second feature with height H2 will be:

$$F2=k\cdot(3H-H) \text{ or } F2=k\cdot 2H.$$

In other words, downforce F2 applied to the second feature with height H2 will be greater than downforce F1 applied to the first feature with height H1 (e.g., F1<F2). In this particular example, downforce F2 applied to the feature with height H2 is two times the downforce F1 applied to the feature with height H1. Therefore, even though the pressure P applied to base 302 is common for all flexible structures 310, the downforce F applied to each feature on the pad by each corresponding flexible structure depends on the compression of the flexible structure, which is in turn proportional to the height of the feature under it. In some embodiments, the downforce applied by the flexible structure 310 to a feature increases as the feature's height increases and respectively reduces as the feature's height reduces. Consequently, taller features are more aggressively treated than shorter features or planar surfaces on pad 102.

In some embodiments, flexible structures 310 are consumables that need to be replaced along with exemplary conditioning wheel or disk 300 over time. In some embodiments, a conditioning wheel with flexible structures needs to be replaced after 1000 to 6000 wafers have been polished in a polisher.

Figure 11:
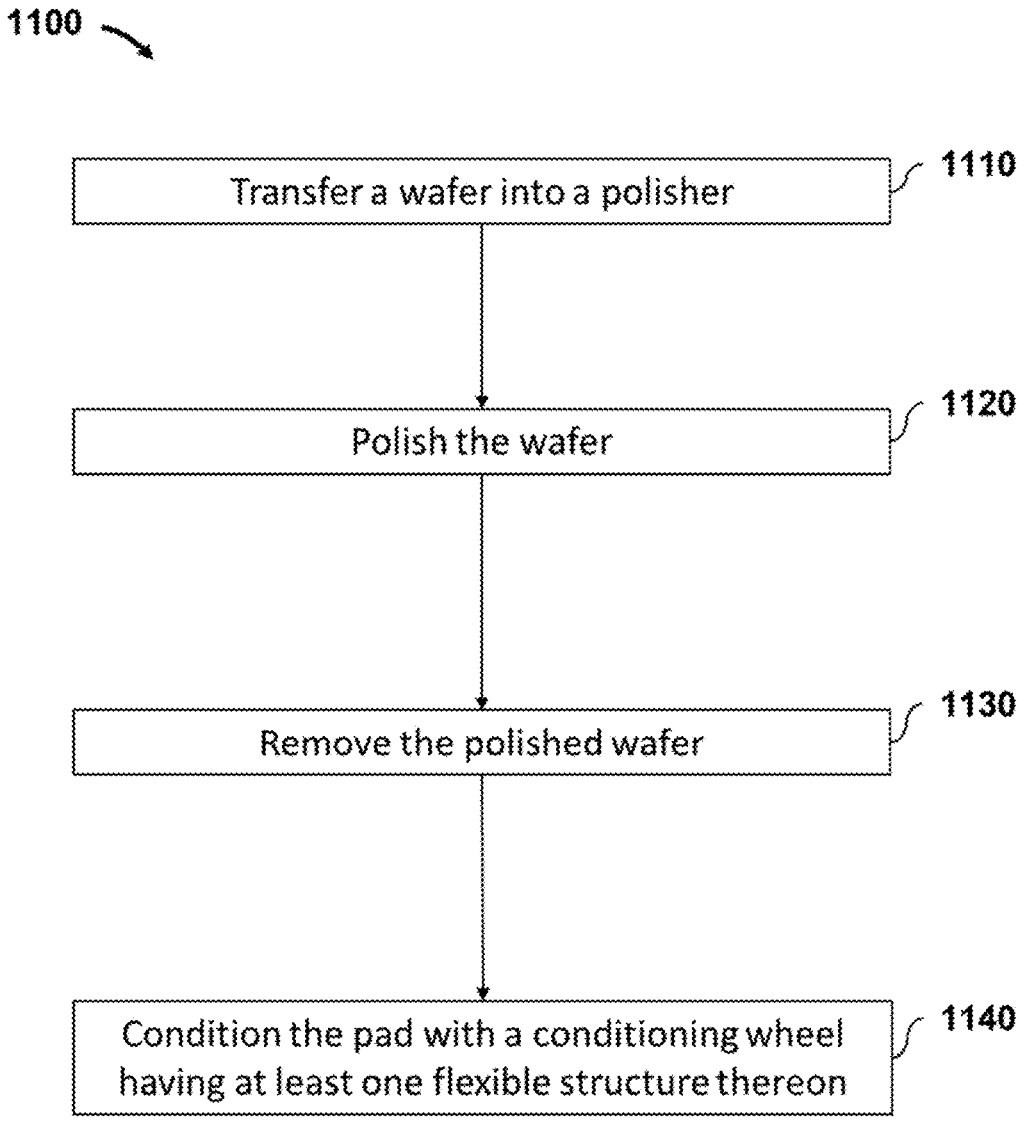
FIG. 11 is a flow chart of a method for conditioning a polishing pad with a conditioning wheel with one or more flexible structures thereon, according to some embodiments.

FIG. 11 is an exemplary method 1100 for conditioning a pad in a polisher using a conditioning wheel having at least one flexible structure thereon, according to some embodiments. This disclosure is not limited to this operational description. It is to be appreciated that additional operations may be performed. Moreover, not all operations may be needed to perform the disclosure provided herein. Further, some of the operations may be performed simultaneously, or in a different order than shown in FIG. 11. In some implementations, one or more other operations may be performed in addition to or in place of the presently described operations. For illustrative purposes, method 1100 is described with reference to the embodiments of FIGS. 1-9. However, method 1100 is not limited to these embodiments.

Exemplary method 1100 begins with operation 1110, where a wafer is transferred into a polisher. Referring to FIG. 1, for example, wafer 112 can be transferred into polisher 100 and placed under wafer carrier 106 so that the side of the wafer to be polished is facing polishing pad 102. In other words, the top surface of wafer 112 is positioned against the top surface of pad 102. Wafer 112 is transferred into polisher 100, for example, from a transfer module with the help of a robotic arm, which is not shown in FIG. 1 merely for simplicity.

In referring to FIG. 11, exemplary method 1100 continues with operation 1120. In operation 1120 wafer 112 is polished. Referring to FIG. 1, the polishing operation includes dispensing slurry 114 through slurry feeder 110 over pad 102 and subsequently rotating wafer carrier 106 and pad 102 (e.g., through platen 104). In some embodiments, wafer carrier 106 and pad 102 rotate in the same direction; however, their respective rotational speeds, or angular speeds, are different. During operation 1120, wafer carrier 106 swings from the center to the edge of pad 102 in the direction of the pad's radius.

In operation 1130, and when wafer 112 is polished, wafer 112 is removed from polisher 100. By way of example and not limitation, wafer 112 can be transferred to another module for rinsing, further polishing, and/or processing.

In operation 1140, a conditioning process on pad 102 of FIG. 1 using a conditioning wheel with at least one flexible structure thereon is performed. In some embodiments, this conditioning wheel is similar to conditioning wheel 300 shown in FIG. 3. Conditioning wheel 300 includes at least one flexible structure 310 which is attached on the surface of base 302 (e.g., backside surface) that is facing the top surface of pad 102 as shown in FIG. 10. In some embodiments, during the conditioning process, wheel 300 and pad 102 rotate in the same direction but with different rotational speeds. Further, in addition to the rotational motion, wheel 300 swings from the center to the edge of pad 102 in the direction of the pad's radius, or on another path across the surface of pad 102.

In some embodiments, pad 102 includes substantially flat areas, features that are elevated compared to the substantially flat areas of the pad, and features that are depressed compared to the substantially flat areas. By way of example and not limitation, the largest height difference between two features on the pad's top surface is no more than about 1 mm. For example, in FIG. 10 the height difference between a flat area with height H1 and an elevated feature with height H2 is about 1 mm or less. According to some embodiments, due to the flexing action (e.g., compression) of the elastic body of flexible structures 310, the downforce applied to features with different heights is different. For example, elevated features receive a greater downforce from flexible structures 310 compared to flat areas of the pad, or features with shorter height. As a result, elevated features are "treated" more aggressively compared to shorter features, depressed features, or flat areas of pad 102.

In some embodiments, the arrangement or number of flexible structures 310 on the backside of base 302 is based on the diameter of base 302, the diameter of flexible structures 310, and the desired spacing S between adjacent flexible structures 310 as shown in FIG. 3. By way of example and not limitation, FIGS. 4A-D are plan-views of the backside surface of base 302 that show exemplary arrangements of flexible structures 310 over the backside surface of base 302. These arrangements are not limiting and other arrangements of flexible structures 310 over the backside surface of base 302 are possible.

As discussed above, each flexible structure 310 includes an elastic body 304, a solid base 306 over the elastic body and a diamond film 308 over the solid base, as shown in FIG. 3. According to some embodiments, elastic body 304 has a height between about 0.1 mm to about 30 mm (e.g., 30 mm), a diameter between about 0.1 mm to about 100 mm, and can include a steel spring, a poromeric (e.g., a porous synthetic material based on polyurethane or another polymer), or an elastometer (e.g. elastic polymer). Each of these materials can have different elastic coefficients or can be fabricated so that they have a specific elastic coefficient. These materials are not limiting and alternative materials can be used. In some embodiments, solid base 306 has a height between about 0.1 mm and about 30 mm, a diameter between about 0.1 and about 30 mm, and can include steel. Alternatively, solid base 306 can be made of a plastic material, metal, or metal alloys. In some embodiments, the diameter of solid base 306 matches the diameter of the underlying elastic body 304. In some embodiments, diamond film 308 has a thickness between about 0.1 mm and about 30 mm (e.g., 30 mm). Additionally, diamond film 308 contacts the pad and "activates" (conditions) the top surface of the pad. Diamond film 308 can have a nanocrystalline or microcrystalline microstructure, according to some embodiments. For example, the size of the diamond microcrystals or nanocrystals in diamond film 308 can range from about 1 μm to about 1000 μm depending on the materials the pad is required to remove from the surface of the wafer.

Further, flexible structures 310 can be attached to the backside surface of base 302 at different depths. For example, in FIG. 3, flexible structures 310 are attached directly on the backside surface of base 302 of conditioning wheel 300, and in FIGS. 5 and 6 flexible structures 310 are partially surrounded by bases 502 and 602, respectively, of conditioning wheels 500 and 600. In some embodiments, and according to FIG. 5, flexible structures 310 are positioned so that the sidewalls of elastic body 304 are partially surrounded by base 502 of conditioning wheel 500. In some embodiments, and according to FIG. 6, flexible structures 310 are positioned so that the sidewalls of elastic body 304 are fully surrounded by base 602 of conditioning wheel 600. In other words, the depth at which elastic body 304 is positioned with respect to the top surface of the backside of base 302 can range from 0 mm to about 30 mm.

In some embodiments, flexible structures 310 include a support frame 710 as shown in FIGS. 7 through 9. Further, height $\mathbf{710}_H$ of support frame 710 can be shorter than the combined height 730 of elastic body 304 and solid base 306. Therefore, height $\mathbf{710}_H$ of support frame 710 can range from about 0.1 mm to about 60 mm. In some embodiments, support frame 710 prevents bending of flexible structures 310 during the conditioning process. For example, due to the combination of rotational forces and downforces applied to flexible structures 310, some flexible structures 310 may become susceptible to bending when traveling over elevated features of the pad's surface. Therefore, support frame 710 ensures that each diamond film 308 of flexible structures 310 contacts the pad's surface at all times during the conditioning process of operation 1140 of FIG. 11.

In some embodiments, operations 1120 and 1140 are not performed in a sequential manner (with operation 1130 intervening between the two operations) and can be performed concurrently. For example, the polishing process and the pad conditioning process can be performed simultaneously. In some embodiments, the use of a pad conditioning wheel with flexible structures 310, as described in some embodiments herein, can extend the lifetime of the treated pad by about 30%.

Further, the pad conditioning wheel with flexible structures can be used to condition polishing pads for a variety of CMP processes, including CMP processes for metals, dielectrics, and other materials. Additionally, the pad conditioning wheel with flexible structures can be used to condition polishing pads for CMP processes employed in different areas of chip manufacturing, such as front end of the line (FEOL), middle of the line (MOL), and back end of the line (BEOL). Further, the pad conditioning wheel with flexible structures can be used to condition polishing pads for any technology area that includes a CMP process.

The present disclose is directed to a pad conditioning wheel with one or more flexible structures. The one or more flexible structures are attached to a surface of the pad conditioning wheel that faces the top surface of the polishing pad. According to some embodiments, the flexible structures include an elastic body that exerts additional downforce to elevated features of the polishing pad compared to flat areas and depressed features of the polishing pad. Therefore, the flatness of the pad's surface can be maintained throughout the pad's lifetime, thus extending the use of the pad. In some embodiments, the lifetime of the polishing pad can be extended up to 30%. In some embodiments, the elastic body includes a steel spring, a poromeric, or an elastomer that can be attached directly under the base of a conditioning wheel. In other embodiments, in addition to the elastic body under the wheel, a support frame is employed to prevent skewing of the wheel's working surface (e.g., the diamond film that contacts the pad). According to some embodiments, the elastic body is located either on the backside surface of a wheel's base or partially in the backside surface of a wheel's base.

In some embodiments, a CMP system includes a pad on a rotating platen, a wafer carrier configured to hold the wafer surface against the pad and apply pressure to the wafer, a slurry dispenser configured to dispense slurry on the pad, and a conditioning wheel configured to condition the pad. The conditioning wheel further includes a base and one or more flexible structures attached to the base with each flexible structure having an elastic body configured to exert a downforce on a feature of the pad, where the downforce is proportional to the height of the feature.

In some embodiments, a pad conditioning wheel includes a rotating base and one or more flexible structures attached to the rotating base, where each of the one or more flexible structures includes: an elastic body configured to exert a downforce to surface features on a pad with different heights, a solid base on the elastic body, a diamond film on the solid base configured to contact the pad in response to the exertion of the downforce from the elastic body, and a support frame configured to prevent the one or more flexible structures from bending.

In some embodiments, a pad conditioning wheel includes a rotating base and one or more flexible structures attached to the rotating base, where each of the one or more flexible structures includes: an elastic body configured to exert a first downforce on a first feature of a pad and a second downforce on a second feature of the pad, where the first downforce is different from the second downwforce. The one or more flexible structures further include a solid base on the elastic body and a diamond film on the solid base.

It is to be appreciated that the Detailed Description section, and not the Abstract of the Disclosure section, is intended to be used to interpret the claims. The Abstract of the Disclosure section may set forth one or more but not all possible embodiments of the present disclosure as contemplated by the inventor(s), and thus, are not intended to limit the subjoined claims in any way.

The foregoing disclosure outlines features of several embodiments so that those skilled in the art may better understand the aspects of the present disclosure. Those skilled in the art will appreciate that they may readily use the present disclosure as a basis for designing or modifying other processes and structures for carrying out the same purposes and/or achieving the same advantages of the embodiments introduced herein. Those skilled in the art will also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical planarization (CMP) system, comprising:

a pad on a rotating platen;

a wafer carrier configured to hold a wafer surface against the pad and apply a pressure to the wafer;

a slurry dispenser configured to dispense slurry on the pad; and a conditioning wheel configured to condition the pad and comprising:

a base; and an array of flexible structures attached to the base, wherein each flexible structure comprises an elastic body configured to exert a downforce on a feature of the pad, and wherein the downforce is proportional to a height of the feature.

2. The CMP system of claim 1, wherein the elastic body comprises a steel spring, a poromeric, or an elastomer.

3. The CMP system of claim 1, wherein the array of flexible structures comprise a support frame surrounding sidewalls of the elastic body and configured to prevent bending of the array of flexible structures.

4. The CMP system of claim 1, wherein the array of flexible structures extend into a backside surface of the base.

5. The CMP system of claim 1, wherein a flexible structure of the array of flexible structures is configured to deform independently with respect to an other flexible structure of the array of flexible structures.

6. The CMP system of claim 1, wherein the array of flexible structures are disposed along a perimeter of the base.

7. A pad conditioning wheel, comprising:

a rotating base; and two or more flexible structures attached to the rotating base and configured to deform independently of each other, wherein each of the two or more flexible structures comprises:

an elastic body configured to exert a downforce to surface features on a pad with different heights;

a solid base on the elastic body;

a diamond film on the solid base configured to contact the pad in response to the exertion of the downforce from the elastic body; and a support frame configured to prevent the two or more flexible structures from bending.

8. The pad conditioning wheel of claim 7, wherein the elastic body comprises a steel spring, a poromeric, or an elastomer.

9. The pad conditioning wheel of claim 7, wherein the elastic body has a height between about 0.1 mm and about 30 mm and a diameter between about 0.1 mm and about 100 mm.

10. The pad conditioning wheel of claim 7, wherein the support frame surrounds at least a portion of a sidewall of the elastic body.

11. The pad conditioning wheel of claim 7, wherein the two or more flexible structures are disposed along a perimeter of the base.

12. The pad conditioning wheel of claim 7, wherein a spacing between each flexible structure of the two or more flexible structures is between about 1 mm and about 100 mm.

13. The pad conditioning wheel of claim 7, wherein a first diameter of a first elastic body is different from a second diameter of a second elastic body.

14. A pad conditioning wheel, comprising:

a rotating base; and a first flexible structure attached to the rotating base, comprising:

a first elastic body configured to exert a first downforce on a first feature of a pad;

a first solid base on the first elastic body; and a first diamond film on the first solid base; and a second flexible structure attached to the rotating base, comprising:

a second elastic body configured to exert a second downforce on a second feature of the pad, wherein the first downforce is different from the second downforce;

a second solid base on the second elastic body; and a second diamond film on the second solid base.

15. The pad conditioning wheel of claim 14, further comprising:

a support frame that surrounds a portion of a sidewall of the first flexible structure and configured to prevent the first flexible structure from bending.

16. The pad conditioning wheel of claim 14, wherein the rotating base encompasses at least portions of the first and second elastic bodies.

17. The pad conditioning wheel of claim 14, wherein the first or the second elastic body has a height between about 0.1 mm and about 30 mm.

18. The pad conditioning wheel of claim 14, wherein the first or the second elastic body has a diameter between about 0.1 mm and about 100 mm.

19. The pad conditioning wheel of claim 14, wherein the first and second elastic bodies respectively comprise first and second diameters different from each other.

20. The pad conditioning wheel of claim 15, wherein a height of the support frame is less than a combined height of the first elastic body and the first solid base.

* * * * *